US009403638B2

(12) United States Patent
Polloni et al.

(10) Patent No.: US 9,403,638 B2
(45) Date of Patent: Aug. 2, 2016

(54) RIGID SWING-OPEN PACKET OF CIGARETTES WITH A SELF-OPENING HINGED LID, AND RELATIVE PRODUCTION METHOD

(75) Inventors: Roberto Polloni, Modigliana (IT); Marco Ghini, Monte San Pietro (IT); Stefano Negrini, Calderara di Reno (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 14/399,207

(22) PCT Filed: May 11, 2012

(86) PCT No.: PCT/IB2012/052366

§ 371 (c)(1),
(2), (4) Date: Nov. 6, 2014

(87) PCT Pub. No.: WO2013/167938

PCT Pub. Date: Nov. 14, 2013

(65) Prior Publication Data

US 2015/0108017 A1 Apr. 23, 2015

(51) Int. Cl.
*B65D 85/10* (2006.01)

(52) U.S. Cl.
CPC ..... *B65D 85/10* (2013.01); *B65D 85/1036* (2013.01); *B65D 85/1054* (2013.01)

(58) Field of Classification Search
CPC . B65D 85/10; B65D 85/1036; B65D 85/1054
USPC ..... 206/256, 257, 268, 271, 261
See application file for complete search history.

(56) References Cited

U.S. PATENT DOCUMENTS

| | | | | |
|---|---|---|---|---|
| 4,534,463 | A | 8/1985 | Bouchard | |
| 5,080,227 | A | 1/1992 | Focke | |
| 7,712,607 | B2 * | 5/2010 | Ghini | B65D 85/1036 206/268 |
| 7,992,708 | B2 * | 8/2011 | Hein | B65D 85/1054 206/271 |
| 8,042,685 | B2 * | 10/2011 | Bourgoin | B65D 85/1054 206/268 |
| 2009/0205982 | A1 | 8/2009 | Hein et al. | |

FOREIGN PATENT DOCUMENTS

| | | | |
|---|---|---|---|
| EP | 2017198 | A1 | 1/2009 |
| FR | 2499947 | A3 | 8/1982 |
| WO | WO-03/053818 | A1 | 7/2003 |
| WO | WO-2006021581 | A1 | 3/2006 |

OTHER PUBLICATIONS

International Search Report and Written Opinion, International Application No. PCT/IB2012/052366, mailed Jan. 14, 2013.

* cited by examiner

*Primary Examiner* — Bryon Gehman
(74) *Attorney, Agent, or Firm* — Marshall, Gerstein & Borun LLP

(57) ABSTRACT

A rigid, swing-open packet of cigarettes having: an inner package containing a group of cigarettes; an inner container housing the inner package and having a hinged lid; an outer container housing the inner container and having at least one open lateral end; a connecting hinge connecting the inner container and outer container to allow the inner container to rotate between a closed position and an open position; and a control tab connecting the lid to the outer container so that rotation of the inner container with respect to the outer container and about the connecting hinge produces a corresponding rotation of the lid about a lid hinge.

16 Claims, 14 Drawing Sheets

RIGID SWING-OPEN PACKET OF CIGARETTES WITH A SELF-OPENING HINGED LID, AND RELATIVE PRODUCTION METHOD

CROSS-REFERENCE TO RELATED APPLICATIONS

This application is the U.S. national phase of PCT/IB2012/052366, filed May 11, 2012.

TECHNICAL FIELD

The present invention relates to a rigid, swing-open packet of cigarettes, and relative production method.

BACKGROUND ART

Rigid, hinged-lid packets of cigarettes are currently the most widely marketed, by being easy to produce and easy and practical to use, and by effectively protecting the cigarettes inside.

In addition, rigid, slide- or swing-open packets of cigarettes have been proposed comprising two containers, one inserted inside and partly extractable from the other, i.e. an inner container containing a group of cigarettes and housed inside an outer container to move, with respect to the outer container, between a closed position inserted inside the outer container, and an open position extracted from the outer container. The movement of the inner container with respect to the outer container may be linear (slide-open) or rotary (swing-open) about a hinge connecting the two containers.

Embodiments of rigid, slide-open packets of cigarettes are described in FR2499947A3, U.S. Pat. No. 4,534,463A and U.S. Pat. No. 5,080,227A, and two embodiments of rigid, swing-open packets of cigarettes in WO03053818A1 and WO2006021581A1.

Patent EP2017198B1 describes a rigid, swing-open packet of cigarettes comprising: two inner packages, each containing a wrapped group of cigarettes; two inner containers, each housing a respective inner package and having a hinged lid; an outer container housing the two inner containers and having two opposite open lateral ends; and two hinges, each connecting an inner container to the outer container to allow the inner container to rotate between a closed position inserted inside the outer container, and an open position at least partly extracted from the outer container. The lid of each inner container has a control system, which connects the lid to the outer container to open the lid 'automatically' (i.e. without the user having to touch the lid) by exploiting the relative movement between the inner container and outer container. Each control system comprises a control tab extending inwards of the outer container from a top-wall edge of the outer container; and a slit formed through the top wall of the lid and engaged by the control tab.

The lid control system described in Patent EP2017198B1, however, has several drawbacks: when the inner container is in the closed position, the top wall of the lid must be kept well clear of the top wall of the outer container, thus preventing optimum use of the volume of the outer container, by having to leave a fairly large empty (i.e. unused) space at the top of the outer container.

DESCRIPTION OF THE INVENTION

It is an object of the present invention to provide a rigid, swing-open packet of cigarettes and relative production method, designed to eliminate the above drawbacks, and which, in particular, are cheap and easy to implement.

According to the present invention, there are provided a rigid, swing-open packet of cigarettes and relative production method, as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
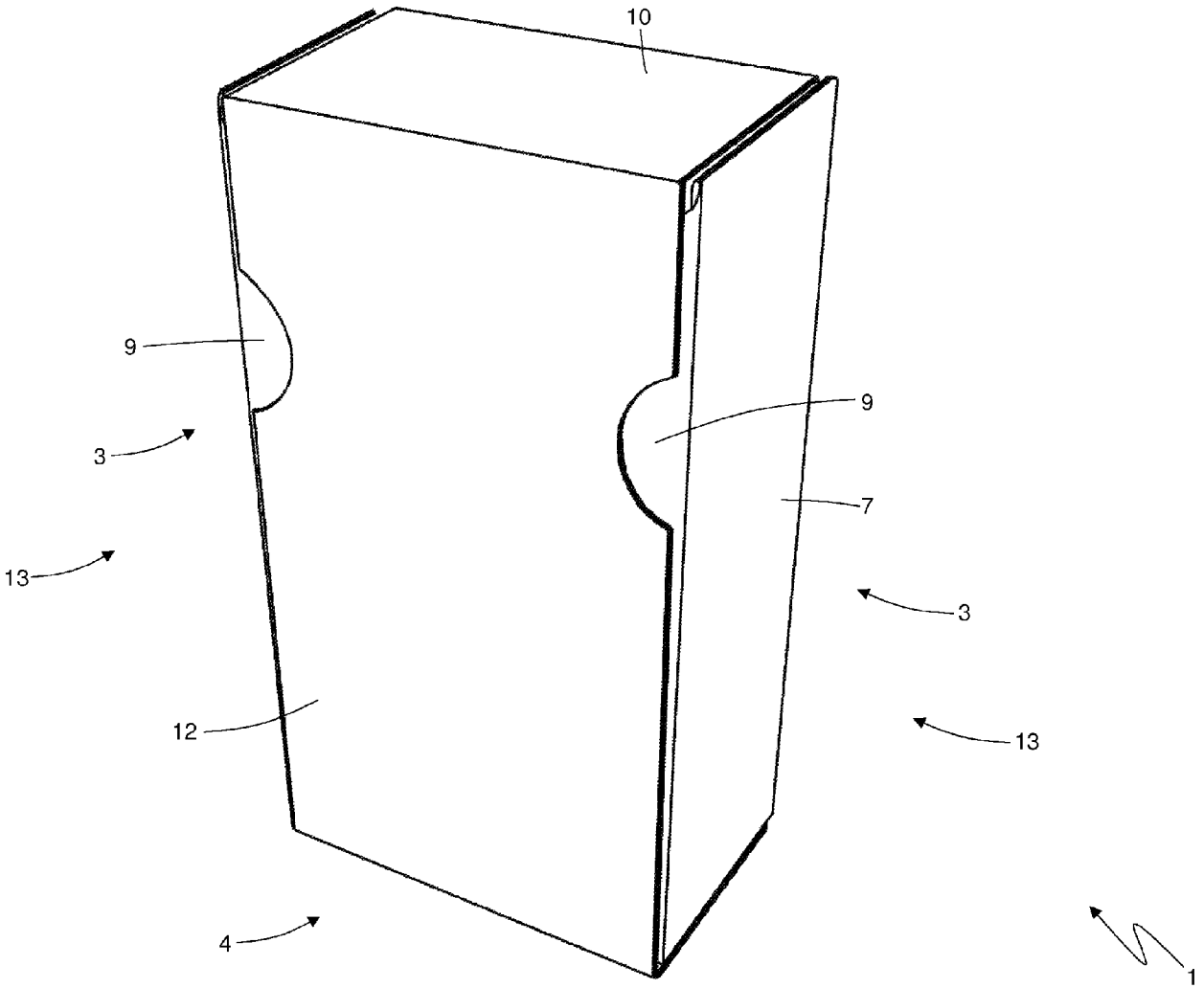
FIG. 1 shows a view in perspective of a rigid, swing-open packet of cigarettes in accordance with the present invention and in the fully-closed position.
Figure 2:
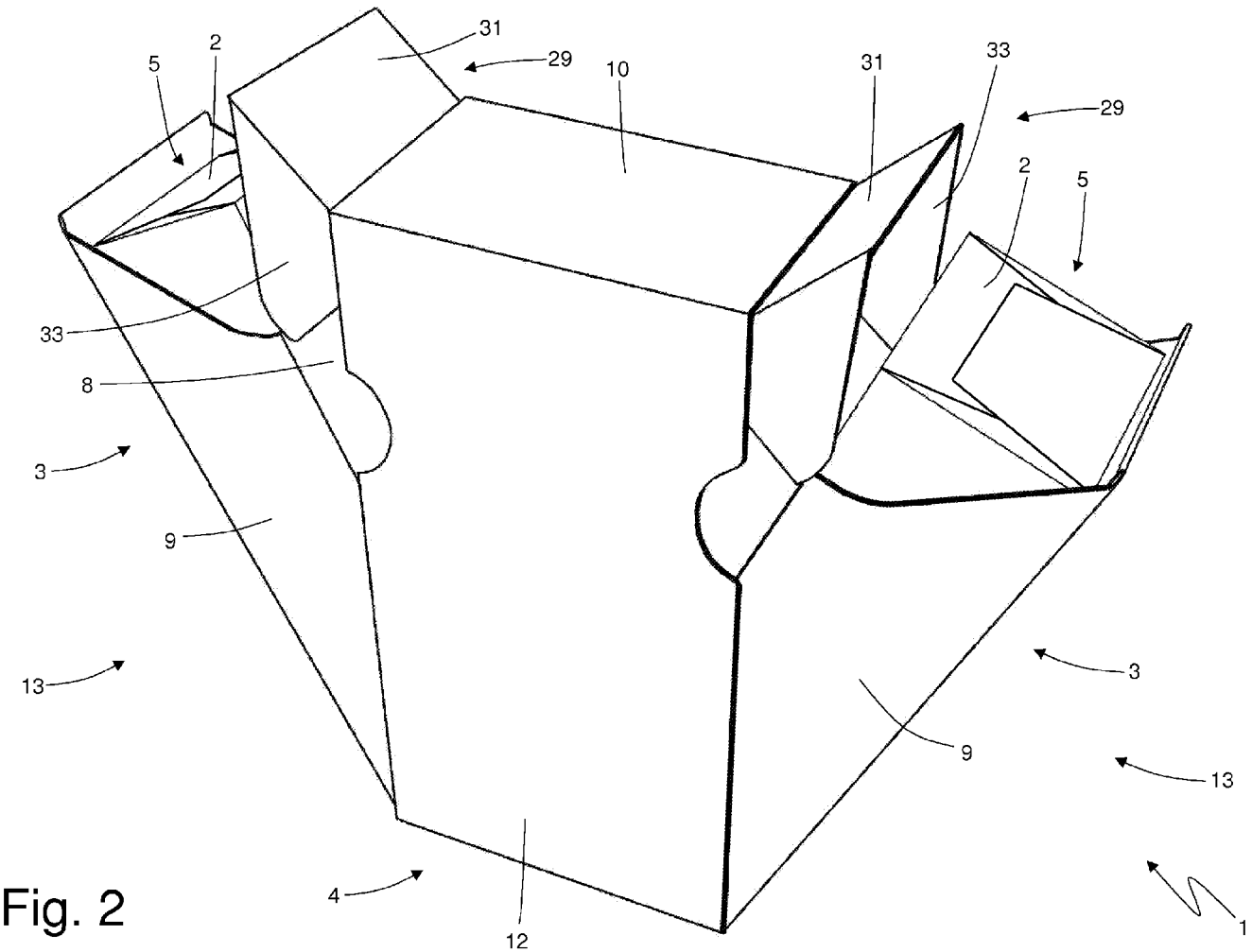
FIG. 2 shows a view in perspective of the FIG. 1 packet of cigarettes in the fully-open position.
Figure 3:
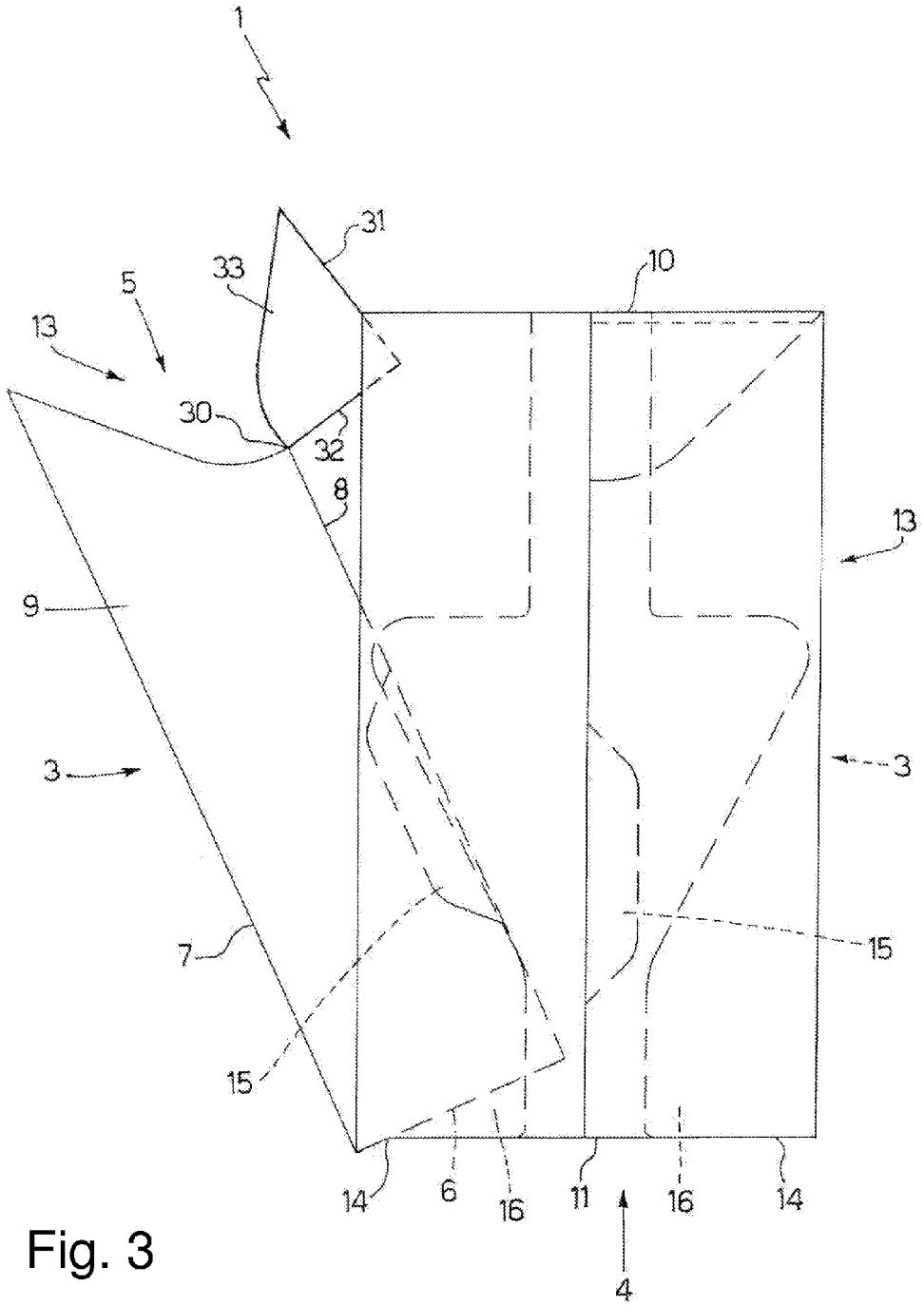
FIG. 3 shows a schematic front view of the FIG. 1 packet of cigarettes in a partly open position.

Number 1 in FIGS. 1-3 indicates as a whole a rigid, swing-open packet of cigarettes.

The packet 1 of cigarettes in FIGS. 1-3 comprises two inner packages 2 (FIG. 2); two rigid, parallelepiped-shaped inner containers 3, each housing an inner package 2; and a rigid, parallelepiped-shaped outer container 4 housing inner containers 3. Each inner package 2 comprises a group of cigarettes arranged in a number of rows; and a sheet of foil wrap wrapped about and fully enclosing the group of cigarettes. Each inner container 3 is hinged to outer container 4 to rotate, with respect to outer container 4, between a closed position (FIG. 1) fully inserted inside outer container 4, and an open position (FIG. 2) partly extracted from outer container 4 for access to inner package 2.

Each inner container 3 is in the form of a cup-shaped parallelepiped, and comprises an open top end 5 for access to inner package 2; a bottom wall 6 opposite open top end 5; a front wall 7; a rear wall 8 opposite and parallel to front wall 7; and two opposite parallel lateral walls 9.

Outer container 4 is also parallelepiped-shaped, and comprises a top wall 10; a bottom wall 11 opposite and parallel to top wall 10; two opposite parallel lateral walls 12; and two opposite open lateral ends 13, through which respective inner containers 3 are extracted/inserted from/into outer container 4 into the open/closed position.

Each inner container 3 is hinged to outer container 4 by a hinge 14 located close to an edge of bottom wall 6 of inner container 3 and an edge of bottom wall 11 of outer container 4, at an open lateral end 13 of outer container 4. More specifically, each hinge 14 is located a given distance from an edge of bottom wall 6 of inner container 3 and an edge of bottom wall 11 of outer container 4, at an open lateral end 13 of outer container 4, i.e. is located a given distance from a bottom transverse edge of inner container 3 and a bottom transverse edge of outer container 4.

In a preferred embodiment, rear wall 8 of each inner container 3 is lower than front wall 7, so that, in the closed position, front wall 7 closes the respective open lateral end 13 of outer container 4 completely, and rear wall 8 does not impede rotation about hinge 14 of inner container 3 with respect to outer container 4 by interfering with top wall 10 of outer container 4. Also, the top portions of lateral walls 9 of each inner container 3 are shaped to connect front wall 7 to rear wall 8 smoothly and compensate for the difference in height.

Packet 1 of cigarettes has stops for limiting withdrawal, and preventing detachment, of each inner container 3 from outer container 4, and which, for each inner container 3, comprise two retaining tabs 15 projecting outwards of inner container 3 from lateral walls 9 and located close to rear wall 8 of inner container 3; and two retaining pockets 16 projecting inwards of outer container 4 from lateral walls 12 and located close to open lateral end 13 of outer container 4. In actual use, when inner container 3 is rotated with respect to outer container 4 about hinge 14 into the open position, each retaining tab 15 slides inside a respective retaining pocket 16 to arrest withdrawal of inner container 3.

To extract an inner container 3, the user of packet 1 of cigarettes must move inner container 3 with respect to outer container 4 by gripping outer container 4 with one hand, and inner container 3 with the other. As shown in FIGS. 1 and 2, for easy grip of inner containers 3, each lateral wall 12 of outer container 4 has a recess close to each open lateral end 13, to allow the user to grip and exert pull on lateral walls 9 of each inner container 3.

In the FIG. 1-3 embodiment, packet 1 of cigarettes comprises two inner containers 3, each housed inside and hinged to outer container 4 by a hinge 14 to rotate between the Open and closed positions. In a different embodiment not shown, packet 1 of cigarettes comprises one inner container 3 housed inside and hinged to outer container 4 by a hinge 14 to rotate between the open and closed positions. In this case, outer container 4 is half the size of outer container 4 in the FIG. 1-3 embodiment, and one of the two open lateral ends 13 of the FIG. 1-3 outer container 4 is closed by a further lateral wall.

As shown in FIGS. 2 and 3, each inner container 3 comprises a lid 29 hinged to inner container 3 by a hinge 30 to rotate with respect to inner container 3 between an open position opening open top end 5, and a closed position closing open top end 5.

Each lid 29 comprises a rectangular top wall 31, which is opposite and parallel to bottom wall 6 of inner container 3 when lid 29 is closed; a rectangular rear wall 32, which forms an extension of rear wall 8 of inner container 3 when lid 29 is closed; and two triangular lateral walls 33, which form extensions of lateral walls 9 of inner container 3 when lid 29 is closed. Hinge 30 of each lid 29 connects a top edge of rear wall 8 of inner container 3 to a bottom edge of rear wall 32 of lid 29.

Figure 4:
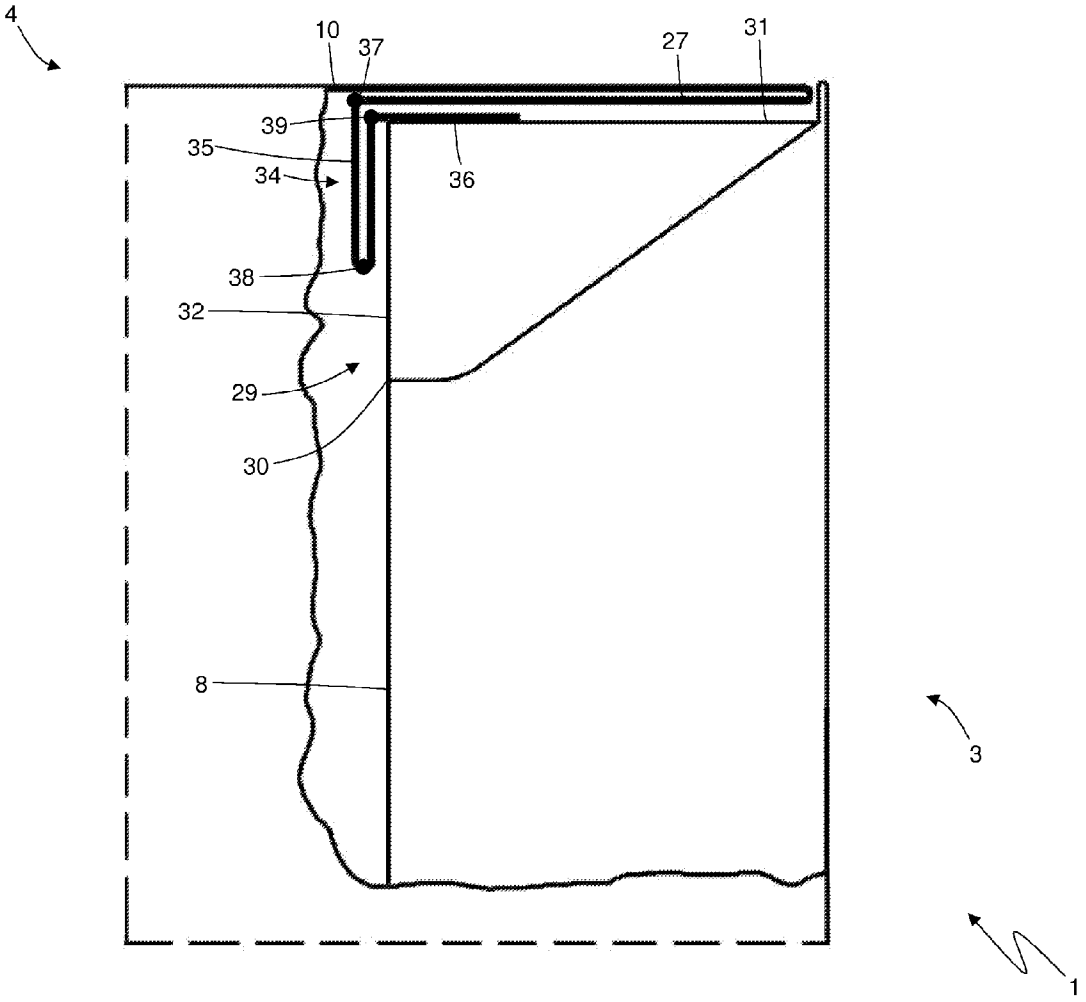
FIGS. 4, 5 and 6 show schematic front views, with parts removed for clarity, of a top portion of the FIG. 1 packet of cigarettes at successive stages in opening an inner container lid.
Figure 5:
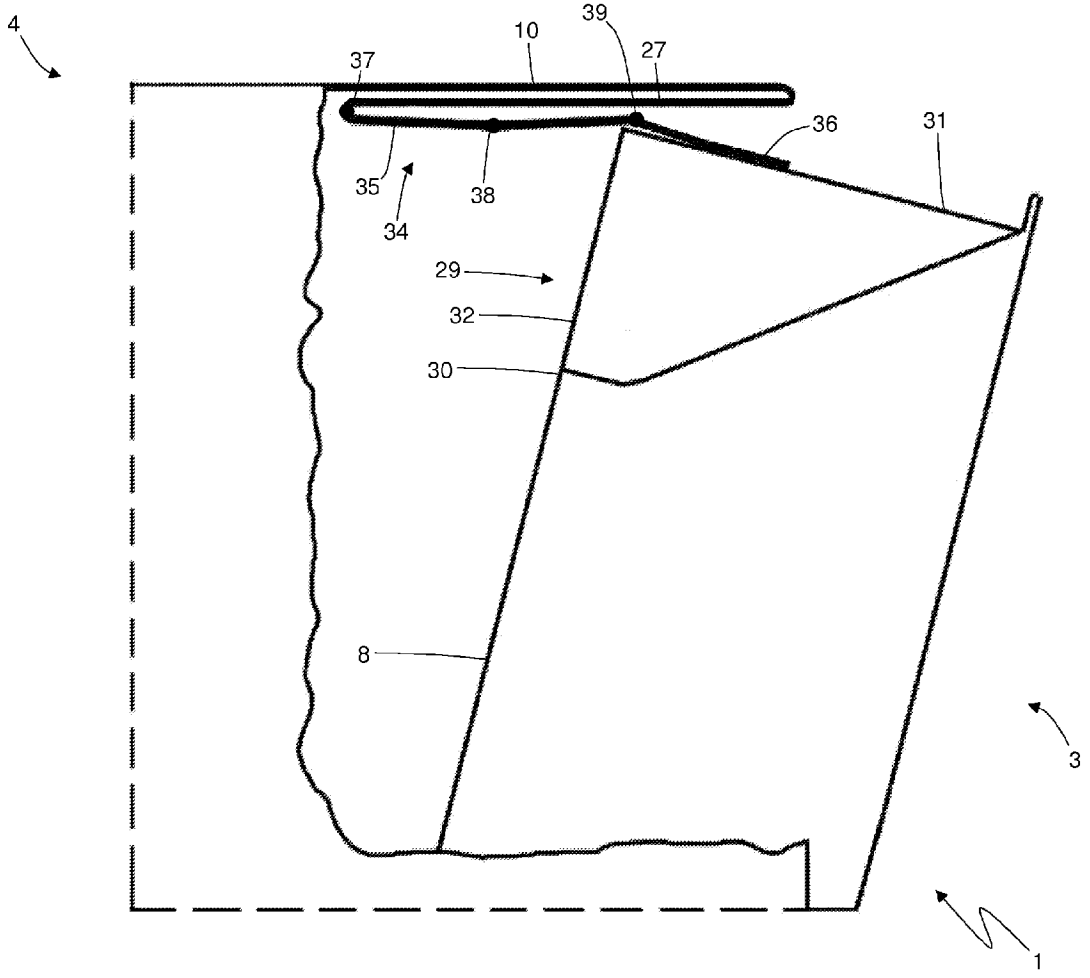
Figure 6:
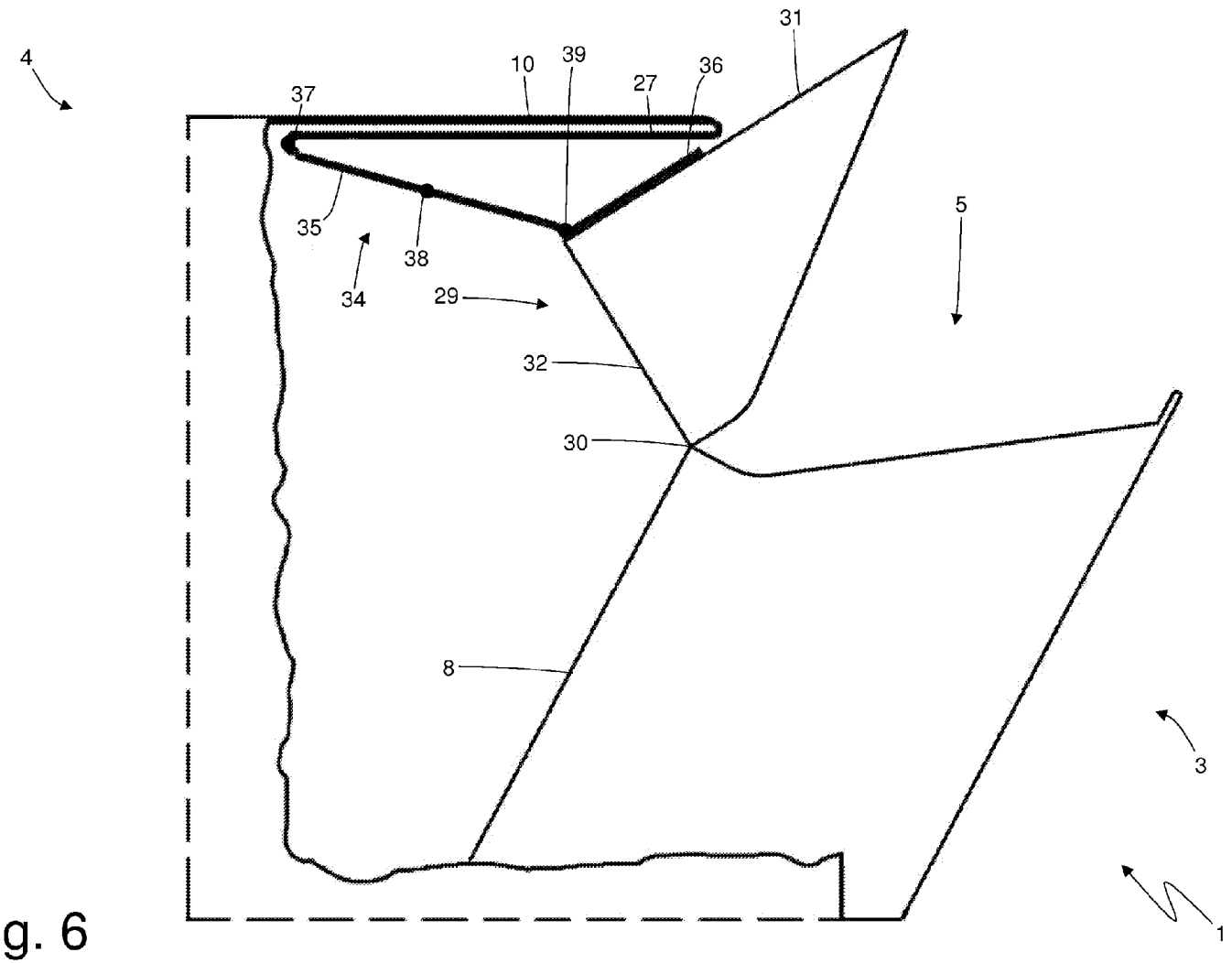

As shown in FIGS. 4, 5 and 6, each lid 29 has a control tab 34 connecting it to outer container 4 so that the movement of inner container 3 with respect to outer container 4 also moves lid 29, without the user having to act directly on lid 29. By virtue of respective control (or connecting) tab 34, each lid 29 therefore opens 'automatically', when respective inner container 3 is extracted, without the user having to act directly on lid 29.

Figure 9:
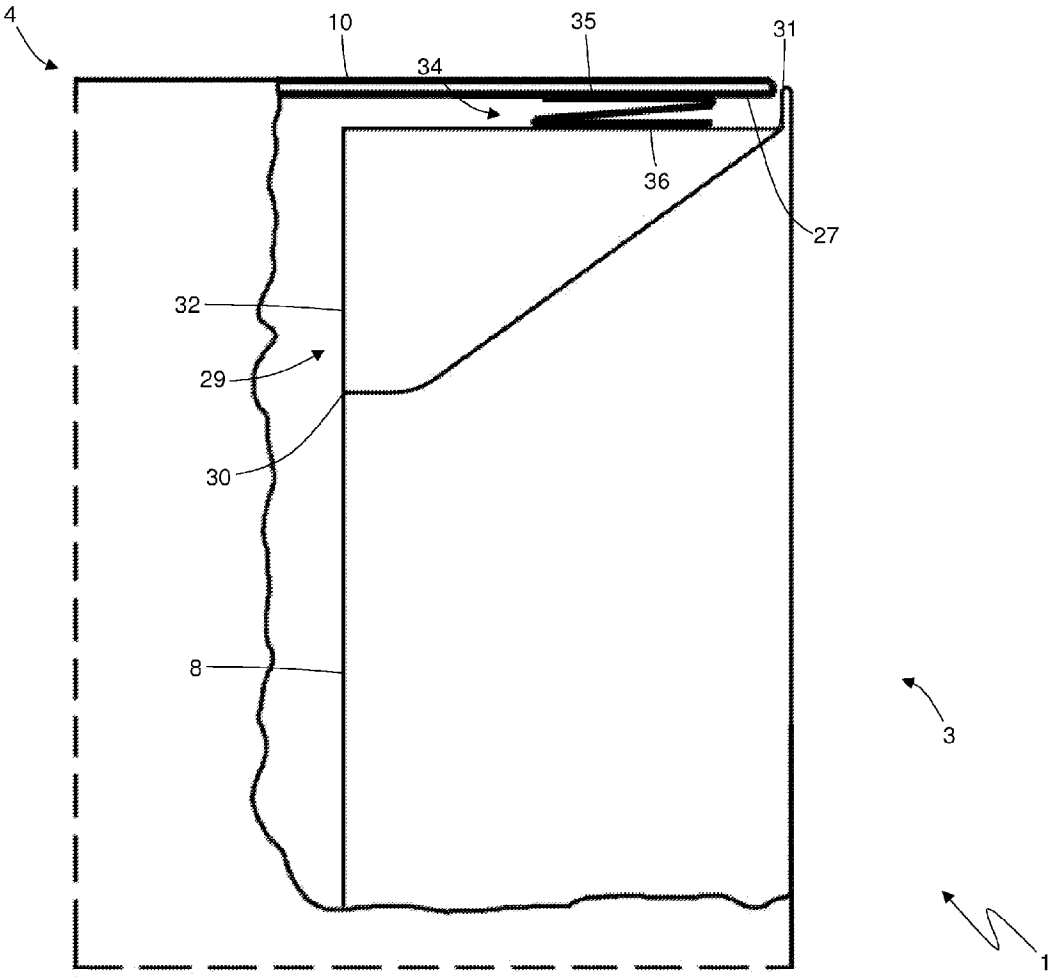
FIGS. 9, 10 and 11 show schematic front views, with parts removed for clarity, of a top portion of an alternative embodiment of the FIG. 1 packet of cigarettes at successive stages in opening an inner container lid.
Figure 10:
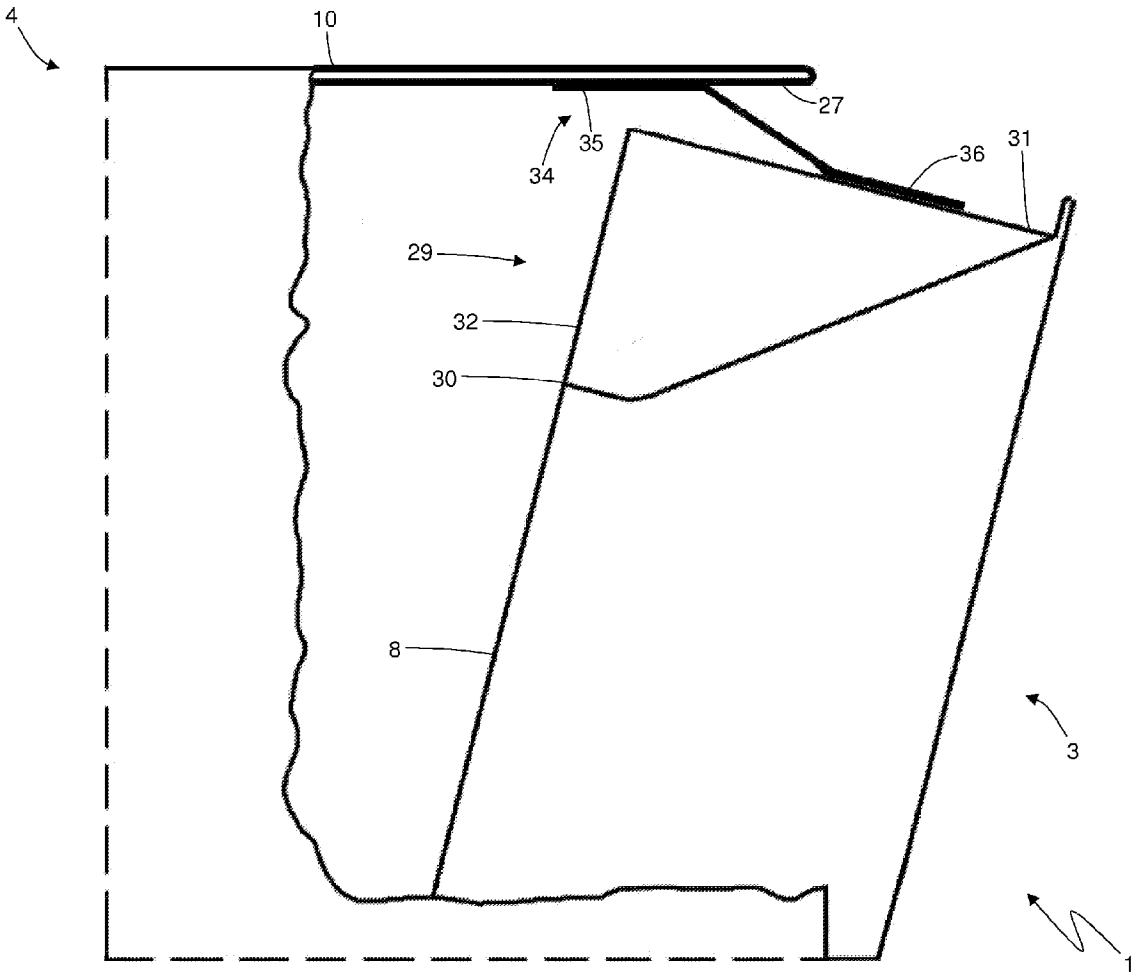
Figure 11:
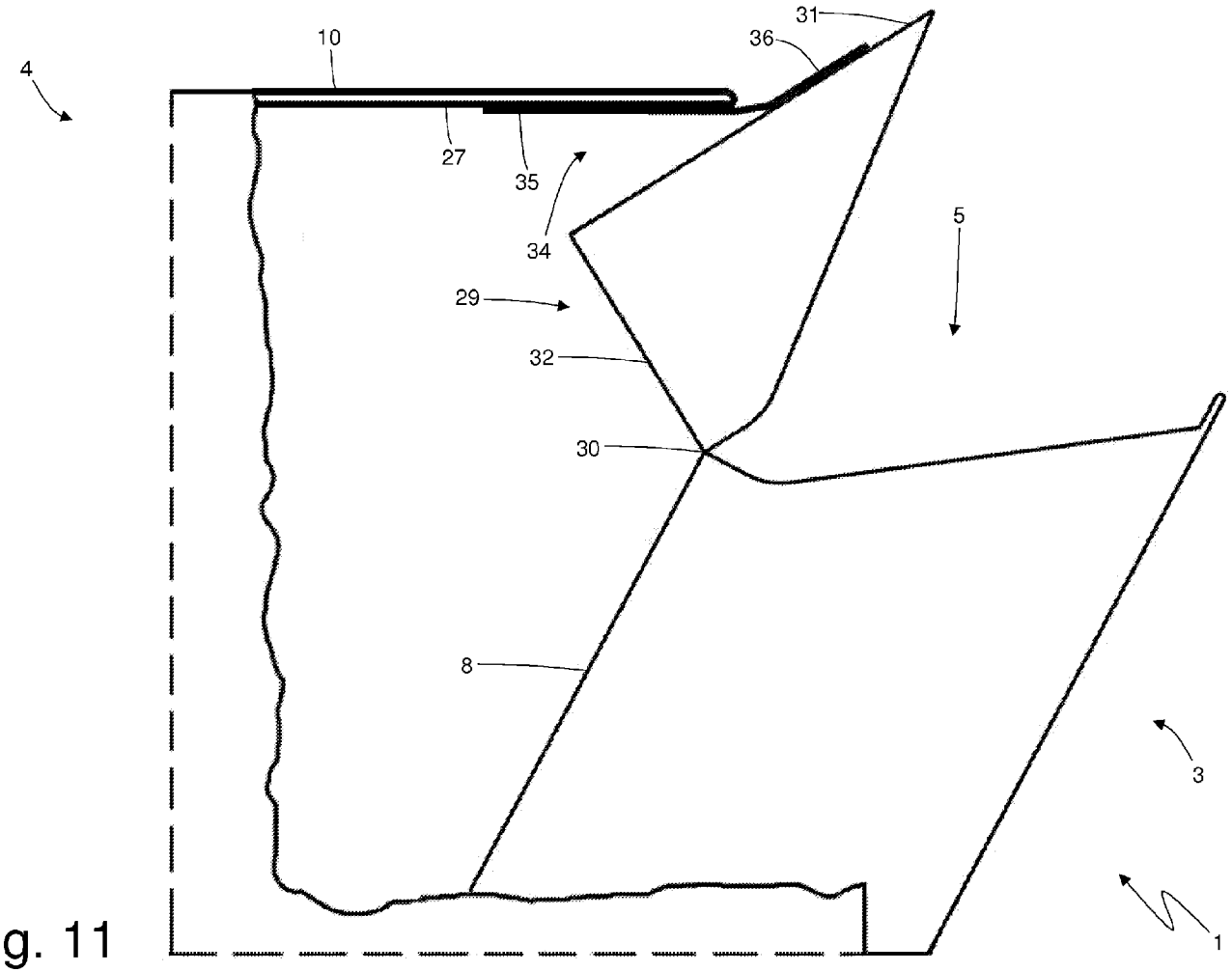

Each control tab 34 has a top end 35 permanently integral with top wall 10 of outer container 4; and a bottom end 36 opposite top end 35 and permanently integral with top wall 31 of lid 29 of corresponding inner container 3. Each control tab 34 folds up (as shown in FIG. 4) when the corresponding inner container 3 is in the closed position inserted inside outer container 4, and unfolds (as shown in FIG. 6) when the corresponding inner container 3 is in the open position, partly extracted from outer container 4. In a preferred embodiment, the bottom end 36 of each control tab 34 is glued to top wall 31 of lid 29, whereas the top end 35 of each control tab 34 may be connected to top wall 10 of outer container 4 along a fold line 37 (as shown in FIGS. 4, 5 and 6) or glued to top wall 10 of outer container 4 (as shown in FIGS. 9, 10 and 11).

In the FIGS. 4, 5 and 6 embodiment, the top end 35 of each control tab 34 is connected to top wall 10 of outer container 4 along fold line 37. More specifically, the top end 35 of each control tab 34 is connected along fold line 37 to a corresponding reinforcing tab 27 for reinforcing top wall 10 of outer container 4 (as explained in detail below, top wall 10 of outer container 4 comprises a panel 10', and two reinforcing tabs 27 glued to the inside of panel 10').

In the FIGS. 4, 5 and 6 embodiment, each control tab 34 has two fold lines 38 and 39 located a given distance apart, between top end 35 and bottom end 36, to allow control tab 34 to fold into an 'L' about top wall 31 and rear wall 32 of lid 29 when the corresponding inner container 3 is in the closed position (FIG. 4) inserted inside outer container 4.

Figure 7:
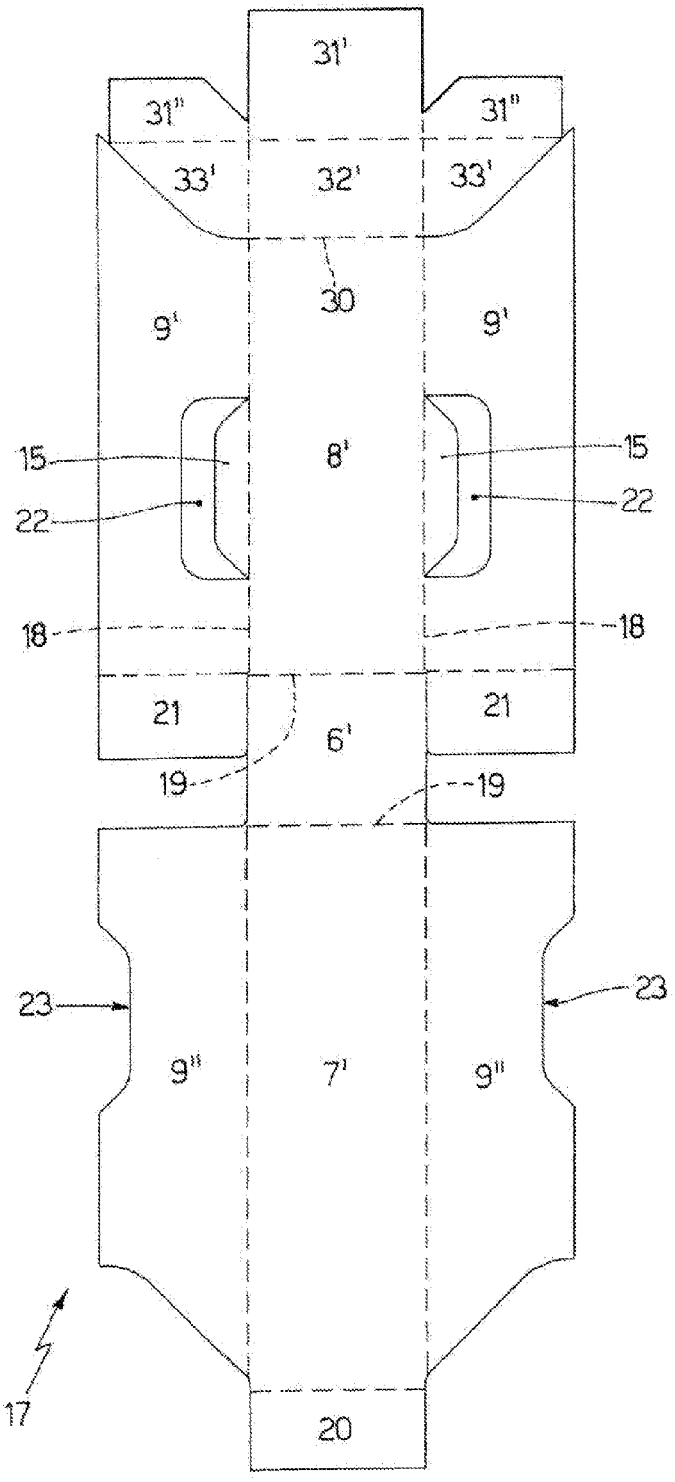
FIG. 7 shows a plan view of a blank from which to form an inner container of the FIG. 1 packet of cigarettes.

As shown in FIG. 7, each inner container 3 is formed by folding a flat, substantially elongated rectangular inner blank 17, the parts of which are indicated, where possible, using the same reference numbers, with superscripts, as for the corresponding parts of inner container 3.

Inner blank 17 has two longitudinal fold lines 18, and a number of transverse fold lines 19 which define, between longitudinal fold lines 18, a panel 8' forming rear wall 8; a panel 6' forming bottom wall 6; and a panel 7' forming front wall 7.

Panel 7' has a reinforcing flap 20 connected to panel 7' along a transverse fold line 19, and which is folded 180° onto panel 7' to reinforce the top of front wall 7.

Panel 8' has two lateral wings 9', which form respective inner portions of lateral walls 9, are located on opposite sides of panel 8', and are separated from panel 8' by longitudinal fold lines 18. Panel 7' has two lateral wings 9", which form respective outer portions of lateral walls 9, are located on opposite sides of panel 7', and are separated from panel 7' by longitudinal fold lines 18. Each lateral wing 9' of panel 8' has a tab 21 separated from lateral wing 9' by a transverse fold line 19, and which is folded 90° with respect to lateral wing 9' and fixed to an inner surface of panel 6'. A window 22, containing a respective retaining tab 15, is formed in each lateral wing 9'; and each lateral wing 9" has a recess 23 designed to overlap a respective retaining tab 15.

Inner blank 17 also comprises a panel 32', which forms rear wall 32 of lid 29 and is connected to panel 8' along hinge 30; a panel 31', which forms top wall 31 of lid 29; and two lateral wings 33' forming lateral walls 33 of lid 29, and each of which has a tab 31", which is folded 90° with respect to lateral wings 33' and fixed to an inner surface of panel 31'.

Figure 8:
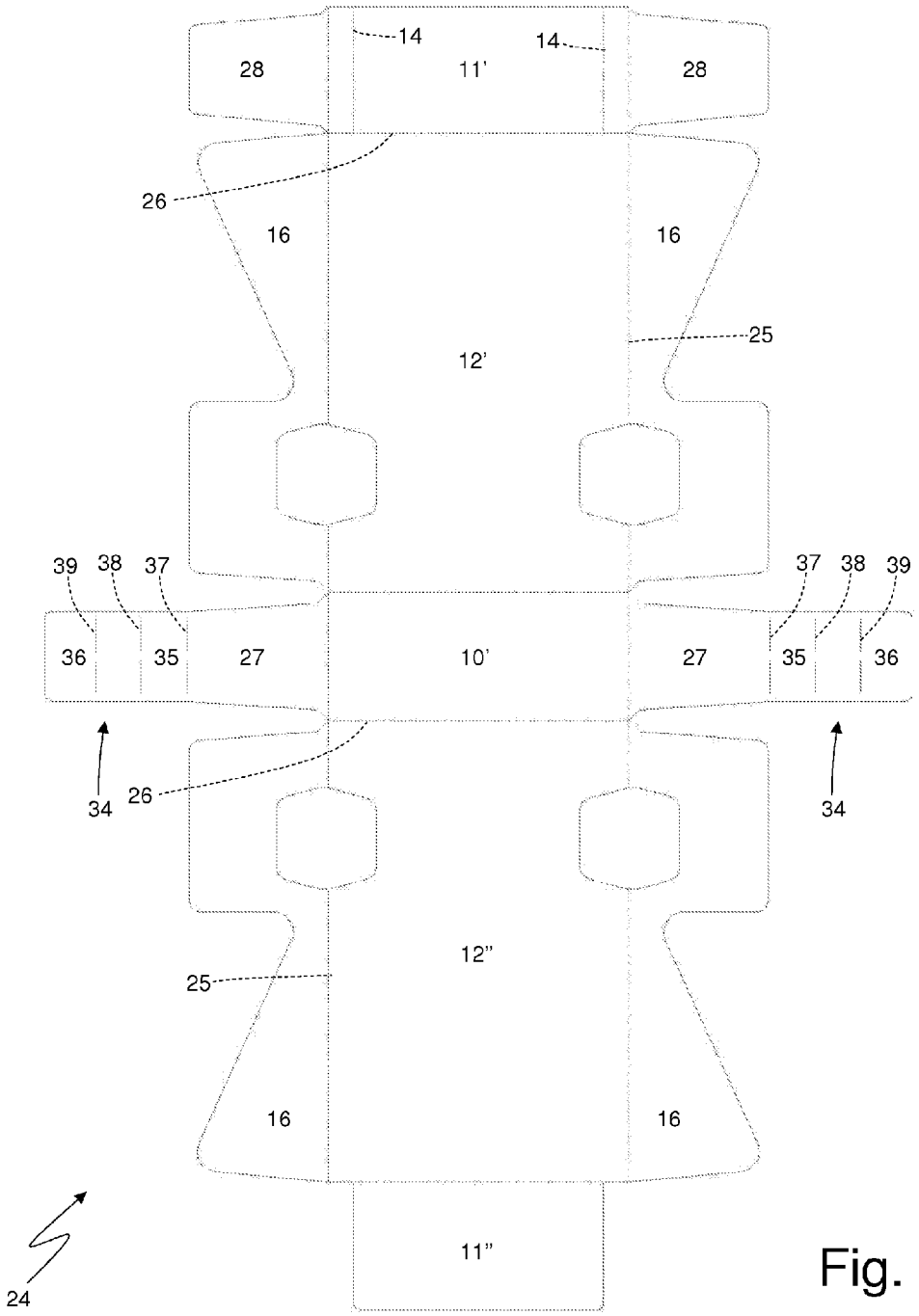
FIG. 8 shows a plan view of a blank from which to form an outer container of the FIG. 1 packet of cigarettes.

As shown in FIG. 8, outer container 4 is formed by folding a flat, substantially elongated rectangular outer blank 24, the parts of which are indicated, where possible, using the same reference numbers, with superscripts, as for the corresponding parts of outer container 4.

Blank 24 has two longitudinal fold lines 25, and a number of transverse fold lines 26 which define, between longitudinal fold lines 25, a panel 11' forming an inner portion of bottom wall 11; a panel 12' forming one lateral wall 12; a panel 10' forming top wall 10; a panel 12" forming the other lateral wall 12; and a panel 11" forming an outer portion of bottom wall 11.

Panel 10' has two reinforcing tabs 27, which are located on opposite sides of panel 10', are separated from panel 10' by longitudinal fold lines 25, and are folded 180° and glued onto panel 10' to reinforce top wall 10.

Panels 12' and 12" each have two retaining pockets 16, which are located on opposite sides of panel 12', 12", are separated from panel 12', 12" by longitudinal fold lines 25, and are folded 180° and glued onto panel 12', 12".

Panel 11' has two connecting tabs 28, which are located on opposite sides of panel 11', are separated from panel 11' by longitudinal fold lines 25, are folded 180° onto panel 11', and are each glued to bottom wall 6 of a respective inner container 3 to hinge inner container 3 to outer container 4.

In the FIGS. 4, 5 and 6 embodiment, the top end 35 of each control tab 34 is connected to top wall 10 (or, rather, to reinforcing tab 27 of top wall 10) of outer container 4 along fold line 37, so control tabs 34 form an integral part of and are made of the same material as outer blank 24 (and therefore outer container 4).

One advantage of the FIGS. 4, 5 and 6 embodiment is that, in the closed position (FIG. 4), the part of each control tab 34 on rear wall 32 of corresponding lid 29 is located between the two inner containers 3 (or, rather, between lids 29 of the two inner containers 3), thus keeping inner containers 3 a given distance apart, which has the advantage of keeping inner containers 3 in the correct position, i.e. preventing them from opening slightly, in the closed position.

In the alternative embodiment in FIGS. 9, 10 and 11, each control tab 34 is initially separate from top wall 10 of outer container 4, and is simply glued to top wall 10 (or, rather, to the corresponding reinforcing tab 27 of top wall 10) of outer container 4. In this embodiment, when inner container 3 is in the closed position (FIG. 9) inserted inside outer container 4, control tab 34 folds up into a 'Z' and is located entirely between top wall 31 of lid 29 and top wall 10 of outer container 4. In a preferred embodiment, each control tab 34 is made of highly flexible, deformable plastic material, which can be folded, even 180°, repeatedly with no significant damage (i.e. fatigue failure). In other words, each control tab 34 comprises a strip of plastic material glued on one side (at top end 35) to top wall 10 of outer container 4, and on the opposite side (at bottom end 36) to top wall 31 of corresponding lid 29. Obviously, each control tab 34 may also be made of paper or multilayer material, e.g. comprising plastic and paper.

Figure 13:
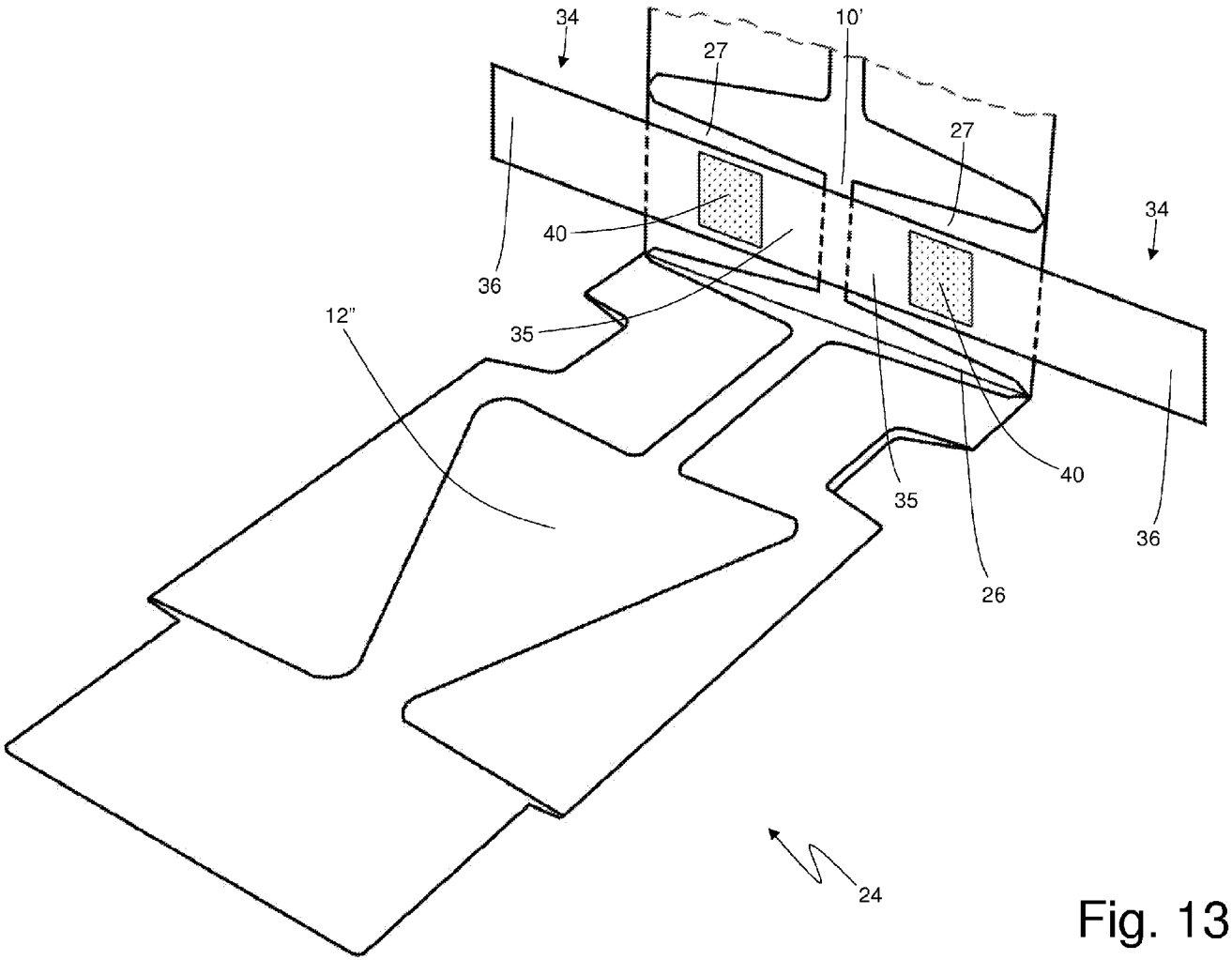
FIGS. 13 and 14 show two production stages, in which a connecting tab is applied to the containers of the FIG. 9, 10, 11 packet of cigarettes.
Figure 14:
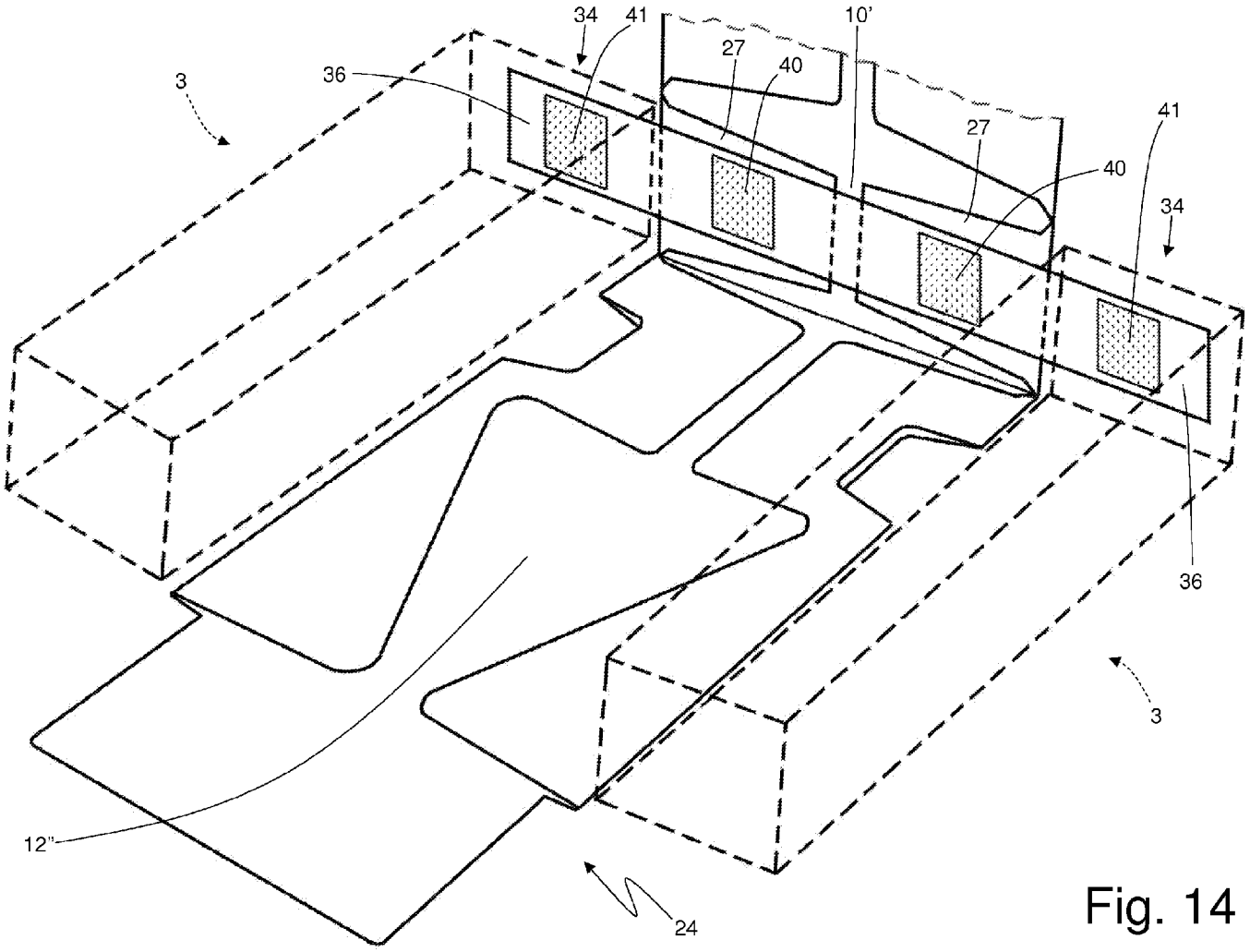

In the FIGS. 9, 10 and 11 embodiment, the two control tabs 34 may be joined at top ends 35 (as shown in FIGS. 13 and 14) into one piece (one strip of material).

Figure 12:
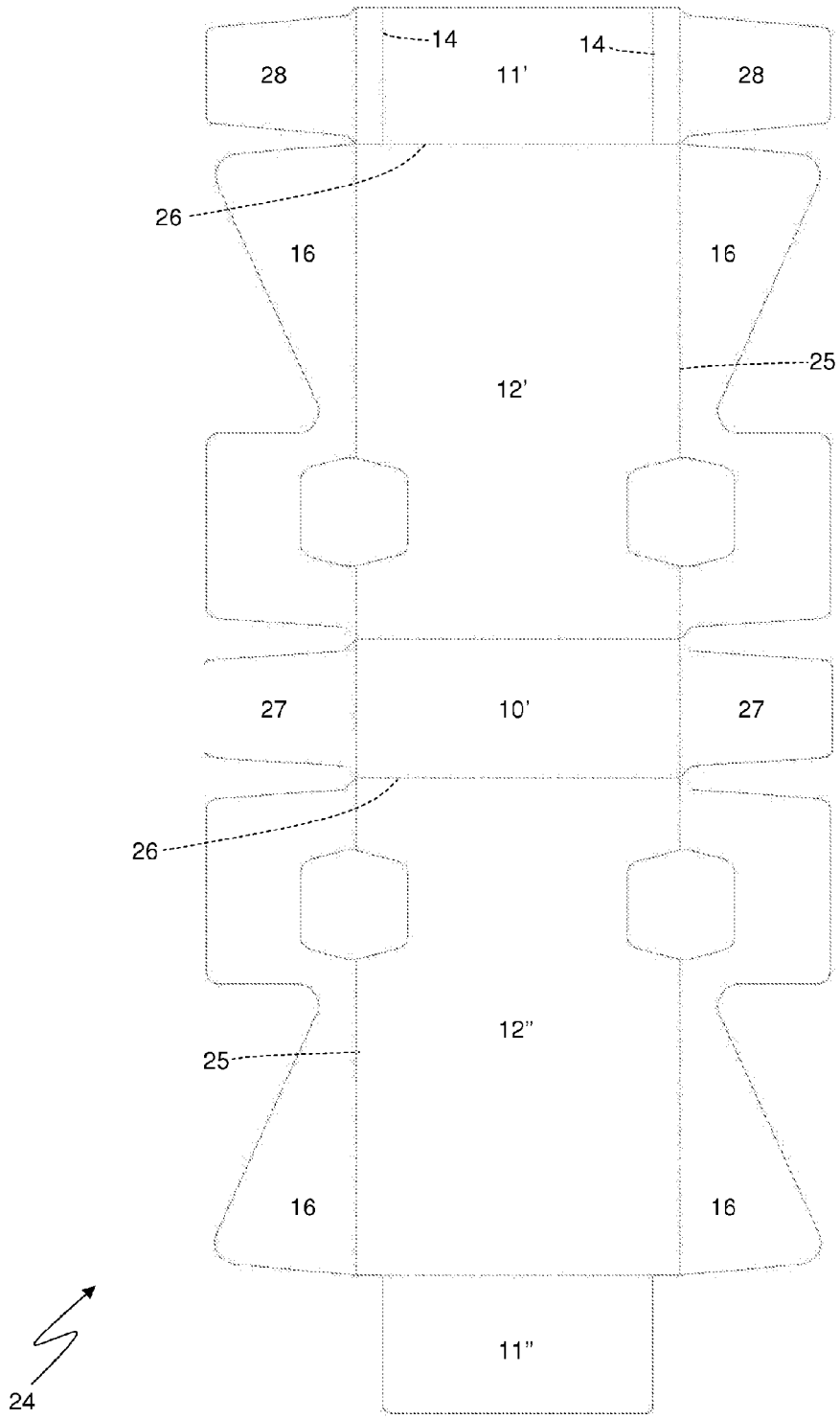
FIG. 12 shows a plan view of a blank from which to form an outer container of the FIG. 9, 10, 11 packet of cigarettes.

Compared with the FIGS. 4, 5 and 6 embodiment (i.e. in which each control tab 34 forms an integral part of outer blank 24 of outer container 4), the FIGS. 9, 10 and 11 embodiment (i.e. in which each control tab 34 is made of plastic material and initially separate from outer blank 24 of outer container 4) has the main advantage of greatly reducing the width of outer blank 24 (as shown by comparing the outer blanks 24 in FIGS. 8 and 12), thus greatly reducing the amount of wastage, and therefore packing material cost, involved in producing outer blanks 24. The FIGS. 9, 10 and 11 embodiment also has the advantage of enabling each control tab 34 to be made from a different material from outer blank 24 of outer container 4 (i.e. a material specially designed for the function of the control tab). In this connection, it is important to bear in mind that each control tab 34 is normally much thinner than the material of containers 3 and 4 (i.e. of blanks 17 and 24).

It is important to note that, in all the embodiments described, control tabs 34 serve solely to open lid 29 'automatically', and withdrawal of inner containers 3 from outer container 4 is limited (arrested) solely by the stops (i.e. by retaining tabs engaging retaining pockets 16). Consequently, each control tab 34 is designed to only unfold completely if the corresponding inner container 3 exceeds the limit posed by the stops. By virtue of the stops, each control tab 34 therefore never unfolds completely, never limits the withdrawal movement of corresponding inner container 3, and therefore never runs any risk of tearing.

Packet 1 of cigarettes described has numerous advantages.

In particular, it enables optimum use of the inner volume of outer container 4, by the design of control tab 34 allowing the top wall 31 of lid 29 to be positioned extremely close to top wall 10 of outer container 4 when inner container 3 is in the closed position. In the FIGS. 4, 5 and 6 embodiment, each control tab 34 is relatively thick, but, in the closed position (FIG. 4), large part of control tab 34 is located 'behind' lid 29 (i.e. rests on rear wall 32 of lid 29) as opposed to 'on top' of lid 29 (i.e. between top wall 31 of lid 29 and top wall 10 of outer container 4). In the FIGS. 9, 10 and 11 embodiment, each control tab 34 is very thin (i.e. much thinner than the material of containers 3 and 4), by being made of plastic material specially designed to connect top wall 31 of lid 29 to top wall 10 of outer container 4.

Packet 1 of cigarettes described is also cheap and easy to produce, by involving only a few minor alterations to a similar standard packet of cigarettes.

A method of producing the above packet 1 of cigarettes will now be described with reference to FIGS. 13 and 14.

The method comprises forming the two inner packages 2; depositing each inner package 2 on a corresponding inner blank 17; folding each inner blank 17 about inner package 2 to form the corresponding inner container 3; depositing the two inner containers 3 on outer blank 24; and folding outer blank 24 about inner containers 3 to form outer container 4.

As shown in FIG. 13, the two control tabs 34 are joined at top ends 35, which are therefore both glued by glue 40 to panel 10' of outer blank 24 (forming top wall 10 of outer container 4) or to reinforcing tabs 27 of panel 10' before depositing inner containers 3 on outer blank 24. Next, as shown in FIG. 14, the bottom end 36 of each control tab 34 is glued by glue 41 to top wall 31 of lid 29 of corresponding inner container 3 when depositing inner container 3 on outer blank 24.

As shown in FIG. 13, the top ends 35 of control tabs 34 are glued simultaneously by glue 40 to respective reinforcing tabs 27 of panel 10' of outer blank 24, with control tabs 34 fully unfolded. As shown in FIG. 14, each inner container 3 is then deposited on the partly prefolded outer blank 24, in a position at least partly outside (alongside) outer blank 24 (i.e. inner container 3, as opposed to resting completely on outer blank 24, is positioned alongside, possibly slightly overlapping, outer blank 24) so as to glue top wall 31 of lid 29 to bottom end 36 of control tab 34 while control tab 34 is unfolded.

Finally, each inner container 3 is moved (translated) with respect to outer blank 24 to rest completely on outer blank 24 (i.e. is moved into a position corresponding to the closed position, in which inner container 3 is inserted inside outer container 4) and so fold up control tab 34 (from the FIG. 14 position, the two inner containers 3 are pushed one against the other, inwards of outer blank 24).

Once the two inner containers 3 are pushed inwards of outer blank 24 (i.e. into the position corresponding to the closed position), outer blank 24 is folded about inner containers 3 to complete packet 1 of cigarettes.

As shown in FIG. 13, panel 10' (together with panels 12' and 11') is folded 90° with respect to panel 12" about a corresponding transverse fold line 26 before depositing the two inner containers 3 on outer blank 24; and the top ends 35 of the two control tabs 34 are preferably glued to reinforcing tabs 27 of panel 10' of outer blank 24 before folding panel 10' (together with panels 12' and 11') 90° with respect to panel 12".

Glue 40 and/or 41 may be applied 'fresh' just before use (i.e. just before end 35 or 36 of control tab 34 is applied to reinforcing tab 27 of panel 10' or to top wall 31 of lid 29), or may be applied in advance (even well in advance), allowed to dry completely before use, and heat-activated when needed (i.e. after applying end 35 or 36 of control tab 34 to reinforcing tab 27 of panel 10' or to top wall 31 of lid 29).

The above method has numerous advantages.

In particular, it provides for producing packets 1 of cigarettes quickly and accurately.

Also, it is cheap and easy to implement, even on existing packing machines, with only a few minor alterations.

The invention claimed is:

1. A rigid, swing-open packet (1) of cigarettes comprising:

an inner package (2) containing a wrapped group of cigarettes;

an inner container (3), which houses the inner package (2) and has an open top end (5), and a lid (29) hinged to the inner container (3) by a lid hinge (30) to rotate with respect to the inner container (3) between an open position and a closed position opening and closing the open top end (5) respectively;

an outer container (4) housing the inner container (3) and having at least one open lateral end (13);

a connecting hinge (14) connecting the inner container (3) and outer container (4) to allow the inner container (3) to rotate between a closed position, in which the inner container (3) is inserted inside the outer container (4), and an open position, in which the inner container (3) is at least partly extracted from the outer container (4); and a control tab (34) connecting the lid (29) to the outer container (4) so that rotation of the inner container (3) with respect to the outer container (4) and about the connecting hinge (14) produces a corresponding rotation of the lid (29) about the lid hinge (30);

wherein the control tab (34) has a top end (35) permanently connected to an inner face of a top wall (10) of the outer container (4); and a bottom end (36) opposite the top end (35) and permanently connected and glued to a top wall (31) of the lid (29) so that, when the inner container (3) is in the closed position inserted inside the outer container (4), the control tab (34) is folded up and is located entirely inside the outer container (4) and, when the inner container (3) is in the open position partly extracted from outer container (4), the control tab (34) is unfolded.

2. A packet (1) of cigarettes as claimed in claim 1, wherein the top end (35) of the control tab (34) is connected to the inner face of the top wall (10) of the outer container (4) along a first fold line (37), and the bottom end (36) of the control tab (34) is glued to the top wall (31) of the lid (29).

3. A packet (1) of cigarettes as claimed in claim 2, wherein:

the top wall (10) of the outer container (4) comprises a first panel (10'), and a reinforcing tab (27) glued to the inside of the first panel (10'); and the top end (35) of the control tab (34) is connected along the first fold line (37) to the reinforcing tab (27) of the top wall (10) of the outer container (4).

4. A packet (1) of cigarettes as claimed in claim 2, wherein the control tab (34) has a second fold line (38) and a third fold line (39) spaced a given distance apart, between the top end (35) and the bottom end (36), to allow the control tab (34) to fold into an 'L' about the top wall (31) of the lid (29) and a rear wall (32) of the lid (29) when the inner container (3) is in the closed position inserted inside the outer container (4).

5. A packet (1) of cigarettes as claimed in claim 1, wherein the top end (35) of the control tab (34) is glued to the inner face of the top wall (10) of the outer container (4), and the bottom end (36) of the control tab (34) is glued to the top wall (31) of the lid (29).

6. A packet (1) of cigarettes as claimed in claim 5, wherein the control tab (34) is initially separate from the top wall (10) of the outer container (4), and is simply glued to the inner face of the top wall (10) of the outer container (4).

7. A packet (1) of cigarettes as claimed in claim 6, wherein the control tab (34) is made of different material from the inner container (3) and the outer container (4).

8. A packet (1) of cigarettes as claimed in claim 5, wherein, when the inner container (3) is in the closed position inserted inside the outer container (4), the control tab (34) folds up into a 'Z' and is located entirely between the inner face of the top wall (31) of the lid (29) and the top wall (10) of the outer container (4).

9. A packet (1) of cigarettes as claimed in claim 1, wherein:

the outer container (4) has two opposite open lateral ends (13);

two inner containers (3) are each housed in the outer container (4), at a respective open lateral end (13), are each hinged to the outer container (4) by a connecting hinge (14) to rotate between the closed and open positions, and each have a hinged lid (29); and two control tabs (34) each have a top end (35) permanently integral with the inner face of the top wall (10) of the outer container (4), and a bottom end (36) opposite the top end (35) and permanently integral with the top wall (31) of the corresponding lid (29).

10. A packet of cigarettes (1) as claimed in claim 9, wherein the two control tabs (34) are joined at the top ends (35).

11. A packet (1) of cigarettes as claimed in claim 1, wherein the connecting hinge (14) is located close to an edge of a bottom wall (6) of the inner container (3), and close to an edge of a bottom wall (11) of the outer container (4), which edges being located at the open lateral end (13) of the outer container (4).

12. A packet (1) of cigarettes as claimed in claim 1, and comprising stops for limiting extraction of the inner container (3) from the outer container (4), and which are entirely different and separate from the control tab (34).

13. A method of producing a rigid, swing-open packet (1) of cigarettes comprising:

an inner package (2) containing a wrapped group of cigarettes;

an inner container (3), which houses the inner package (2) and has an open top end (5), and a lid (29) hinged to the inner container (3) by a lid hinge (30) to rotate with respect to the inner container (3) between an open position and a closed position opening and closing the open top end (5) respectively;

an outer container (4) housing the inner container (3) and having at least one open lateral end (13);

a connecting hinge (14) connecting the inner container (3) and outer container (4) to allow the inner container (3) to rotate between a closed position, in which the inner container (3) is inserted inside the outer container (4), and an open position, in which the inner container (3) is at least partly extracted from the outer container (4); and a control tab (34) connecting the lid (29) to the outer container (4) so that rotation of the inner container (3) with respect to the outer container (4) and about the connecting hinge (14) produces a corresponding rotation of the lid (29) about the lid hinge (30);

the method comprising the steps of:

forming the inner package (2);

depositing the inner package (2) on an inner blank (17);

folding the inner blank (17) about the inner package (2) to form the inner container (3);

depositing the inner container (3) on an outer blank (24); and folding the outer blank (24) about the inner container (3) to form the outer container (4);

the method being characterized by comprising the further steps of:

gluing a top end (35) of the control tab (34) to an inner face of a first panel (10') of the outer blank (24) forming a top wall (10) of the outer container (4), before depositing the inner container (3) on the outer blank (24); and gluing a bottom end (36) of the control tab (34) to a top wall (31) of the lid (29) when depositing the inner container (3) on the outer blank (24) so that, when the inner container (3) is in the closed position inserted inside the outer container (4), the control tab (34) is folded up and is located entirely inside the outer container (4) and, when the inner container (3) is in the open position partly extracted from outer container (4), the control tab (34) is unfolded.

14. A method as claimed in claim 13, and comprising the further steps of:

gluing the top end (35) of the control tab (34) to the inner face of the first panel (10') of the outer blank (24), with the control tab (34) unfolded;

depositing the inner container (3) on the outer blank (24) in a position at least partly outside the outer blank (24), so as to glue the top wall (31) of the lid (29) to the bottom end (36) of the unfolded control tab (34); and moving the inner container (3), with respect to the outer blank (24), into a position corresponding to the closed position in which the inner container (3) is inserted inside the outer container (4), so as to fold up the control tab (34).

15. A method as claimed in claim 14, and comprising the further step of folding the first panel (10') 90° with respect to a second panel (12") forming a major lateral wall (12) of the outer container (4), before depositing the inner container (3) on the outer blank (24).

16. A method as claimed in claim 15, and comprising the further step of gluing the top end (35) of the control tab (34) to the first panel (10') before folding the first panel (10') 90° with respect to the second panel (12").

* * * * *